US010801729B2

(12) United States Patent
Bloom

(10) Patent No.: US 10,801,729 B2
(45) Date of Patent: Oct. 13, 2020

(54) THERMALLY COUPLED CMC COMBUSTOR LINER

(71) Applicant: General Electric Company, Schenectady, NY (US)

(72) Inventor: Nicholas John Bloom, Maineville, OH (US)

(73) Assignee: General Electric Company, Schenectady, NY (US)

( * ) Notice: Subject to any disclaimer, the term of this patent is extended or adjusted under 35 U.S.C. 154(b) by 1686 days.

(21) Appl. No.: 14/791,539

(22) Filed: Jul. 6, 2015

(65) Prior Publication Data

US 2020/0158341 A1 May 21, 2020

(51) Int. Cl.
*F23R 3/00* (2006.01)
*F23R 3/60* (2006.01)

(52) U.S. Cl.
CPC ..... *F23R 3/60* (2013.01); *F23R 3/002* (2013.01); *F23R 3/007* (2013.01); *F23R 2900/00012* (2013.01); *F23R 2900/00017* (2013.01); *F23R 2900/00018* (2013.01)

(58) Field of Classification Search
CPC .. F23R 3/002; F23R 3/007; F23R 3/60; F23R 2900/00017; F23R 2900/00018; F23R 2900/00012
See application file for complete search history.

(56) References Cited

U.S. PATENT DOCUMENTS 3,604,716 A 9/1971 Webert
5,285,632 A 2/1994 Halila
5,291,732 A 3/1994 Halila
5,291,733 A 3/1994 Halila
5,330,321 A 7/1994 Roberts et al.
(Continued)

FOREIGN PATENT DOCUMENTS

EP 1 265 031 A1 12/2002
EP 1 818 614 A1 8/2007
(Continued)

OTHER PUBLICATIONS

Extended European Search Report and Opinion issued in connection with corresponding EP Application No. 16177474.0 dated Dec. 6, 2016.

(Continued)

*Primary Examiner* — Todd E Manahan
*Assistant Examiner* — Edwin Kang
(74) *Attorney, Agent, or Firm* — Dority & Manning, P.A.

(57) ABSTRACT

A combustor for a gas turbine engine is provided, which includes: a CMC liner having a forward end and an aft end; an annular dome comprising a metal and defining an annular slot within its end defined between an outer arm and an inner arm; a feather seal extending from an annularly exterior surface of the annular dome to an annularly exterior surface of the liner; and a plurality of pin members. The forward end of the liner defines a plurality of fingers and a plurality of axial slots, and is fitted between the outer arm and the inner arm within the annular slot. Each pin member extending through an aperture in the feather seal, through an aperture in the outer arm of the annular dome, through an opening defined by the liner, and through an aperture in the inner arm of the annular dome.

18 Claims, 5 Drawing Sheets

(56) References Cited

U.S. PATENT DOCUMENTS

| | | | | |
|---|---|---|---|---|
| 5,524,430 | A | 6/1996 | Mazeaud et al. | |
| 5,680,767 | A | 10/1997 | Lee et al. | |
| 6,397,603 | B1 | 6/2002 | Edmondson | |
| 6,435,514 | B1 | 8/2002 | Aksit et al. | |
| 6,840,519 | B2 | 1/2005 | Dinc et al. | |
| 6,904,757 | B2 | 6/2005 | Mitchell et al. | |
| 7,572,099 | B2 | 8/2009 | Addis | |
| 8,141,370 | B2 | 3/2012 | Bulman et al. | |
| 8,834,056 | B2 | 9/2014 | Keith et al. | |
| 9,879,556 | B2 * | 1/2018 | Chuong | F01D 25/30 |
| 2002/0184886 | A1 * | 12/2002 | Calvez | F23R 3/007 60/796 |
| 2004/0036230 | A1 * | 2/2004 | Matsuda | F01D 9/023 277/632 |
| 2004/0250548 | A1 * | 12/2004 | Howell | F23R 3/002 60/796 |
| 2006/0101827 | A1 * | 5/2006 | Ryan | F23R 3/007 60/796 |
| 2007/0180809 | A1 | 8/2007 | Bessagnet et al. | |
| 2010/0102144 | A1 * | 4/2010 | Conete | F01D 25/243 239/265.11 |
| 2011/0271684 | A1 | 11/2011 | Corsmeier et al. | |
| 2012/0304657 | A1 * | 12/2012 | Melton | F23R 3/60 60/752 |
| 2015/0128610 | A1 * | 5/2015 | Salunkhe | F01D 9/023 60/800 |
| 2016/0102568 | A1 * | 4/2016 | Grant | F01D 9/065 415/115 |

FOREIGN PATENT DOCUMENTS

| | | | |
|---|---|---|---|
| FR | 2 887 615 | A1 | 12/2006 |
| JP | 2003-021335 | A | 1/2003 |

OTHER PUBLICATIONS

Office Action issued in connection with corresponding CA Application No. 2934096 dated Mar. 21, 2017.

Decision to Grant issued in connection with corresponding JP Application No. 2016-127126 dated Jun. 6, 2017.

* cited by examiner

THERMALLY COUPLED CMC COMBUSTOR LINER

FIELD OF THE INVENTION

The present invention relates generally to the use of Ceramic Matrix Composite (CMC) liners in a gas turbine engine combustor and, in particular, to the mounting of such CMC liners to the dome and cowl of the combustor so as to accommodate differences in thermal growth therebetween.

BACKGROUND OF THE INVENTION

It will be appreciated that the use of non-traditional high temperature materials, such as Ceramic Matrix Composites (CMC), are being studied and utilized as structural components in gas turbine engines. There is particular interest, for example, in making combustor components which are exposed to extreme temperatures from such material in order to improve the operational capability and durability of the engine. However, substitution of materials having higher temperature capabilities than metals has been difficult in light of the widely disparate coefficients of thermal expansion when different materials are used in adjacent components of the combustor. This mismatch can result in binding with adjacent components and subsequent failure unless sufficient clearance is available.

Accordingly, various schemes have been employed to address problems that are associated with mating parts having differing thermal expansion properties. As seen in U.S. Pat. No. 5,291,732 to Halila, U.S. Pat. No. 5,291,733 to Halila, and U.S. Pat. No. 5,285,632 to Halila, an arrangement is disclosed which permits a metal heat shield to be mounted to a liner made of CMC so that radial expansion therebetween is accommodated. This involves positioning a plurality of circumferentially spaced mount pins through openings in the heat shield and liner so that the liner is able to move relative to the heat shield.

U.S. Pat. No. 6,397,603 to Edmondson et al. also discloses a combustor having a liner made of Ceramic Matrix Composite materials, where the liner is mated with an intermediate liner dome support member in order to accommodate differential thermal expansion without undue stress on the liner. The Edmondson et al. patent further includes the ability to regulate part of the cooling air flow through the interface joint.

While each of the aforementioned patents reveals mounting arrangements for a CMC liner which are useful for their particular combustor designs, none involve a liner made of CMC materials being connected directly to the dome and cowl portions of the combustor in a single mounting arrangement. Thus, it would be desirable for a simple mounting assembly to be developed for a liner having a different coefficient of thermal expansion than the components to which it is mated. It would also be desirable for such mounting assembly to be efficiently sized such that clearances with adjacent hardware are not required.

BRIEF DESCRIPTION OF THE INVENTION

Aspects and advantages of the invention will be set forth in part in the following description, or may be obvious from the description, or may be learned through practice of the invention.

A combustor for a gas turbine engine is generally provided. In one embodiment, the combustor comprises: a liner comprising a ceramic matrix composite material and having a forward end and an aft end; an annular dome comprising a metal and defining an annular slot within its end defined between an outer arm and an inner arm; a feather seal extending from an annularly exterior surface of the annular dome to an annularly exterior surface of the liner; and a plurality of pin members. The forward end of the liner defines a plurality of fingers and a plurality of axial slots, and is fitted between the outer arm and the inner arm within the annular slot. Each pin member extending through an aperture in the feather seal, through an aperture in the outer arm of the annular dome, through an opening defined by the liner, and through an aperture in the inner arm of the annular dome.

A gas turbine engine is also generally provided, which comprises a compressor; a combustor; and a turbine. The combustor generally comprises: a liner comprising a ceramic matrix composite material and having a forward end and an aft end; an annular dome comprising a metal and defining an annular slot within its end defined between an outer arm and an inner arm; a feather seal extending from an annularly exterior surface of the annular dome to an annularly exterior surface of the liner; and a plurality of pin members. The forward end of the liner defines a plurality of fingers and a plurality of axial slots, and is fitted between an outer arm and an inner arm within the annular slot. Each pin member extending through an aperture in the feather seal, through an aperture in the outer arm of the annular dome, through an opening defined by the liner, and through an aperture in the inner arm of the annular dome.

A liner of a combustor is also generally provided. In one embodiment, the liner comprises a ceramic matrix composite material, with the liner having a forward end that defines a plurality of fingers and a plurality of axial slots.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
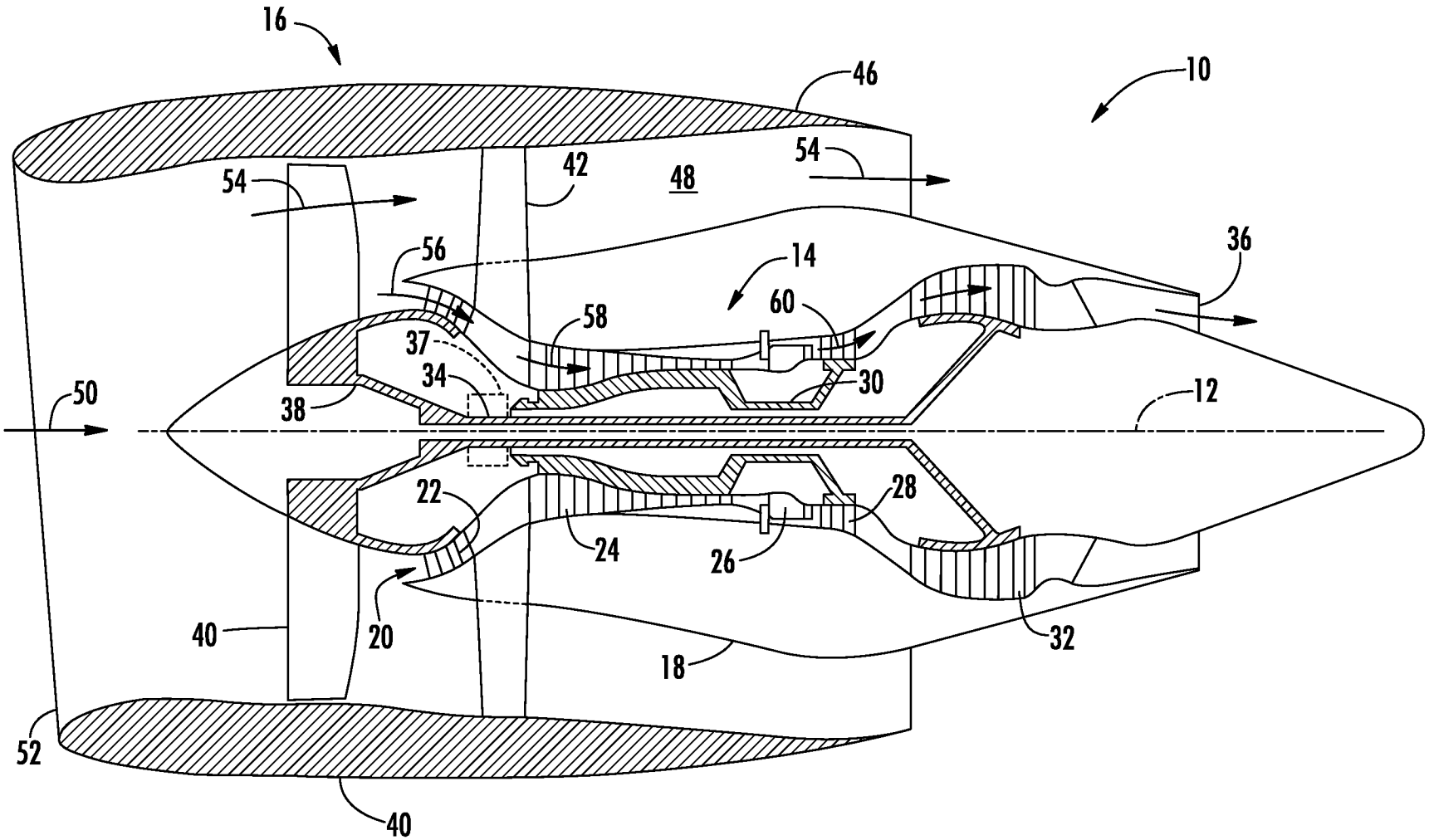
FIG. 1 illustrates a cross-sectional view of one embodiment of a gas turbine engine that may be utilized within an aircraft in accordance with aspects of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Referring now to the drawings, FIG. 1 illustrates a cross-sectional view of one embodiment of a gas turbine engine 10 that may be utilized within an aircraft in accordance with aspects of the present subject matter, with the engine 10 being shown having a longitudinal or axial centerline axis 12 extending therethrough for reference purposes. In general, the engine 10 may include a core gas turbine engine (indicated generally by reference character 14) and a fan section 16 positioned upstream thereof. The core engine 14 may generally include a substantially tubular outer casing 18 that defines an annular inlet 20. In addition, the outer casing 18 may further enclose and support a booster compressor 22 for increasing the pressure of the air that enters the core engine 14 to a first pressure level. A high pressure, multi-stage, axial-flow compressor 24 may then receive the pressurized air from the booster compressor 22 and further increase the pressure of such air. The pressurized air exiting the high-pressure compressor 24 may then flow to a combustor 26 within which fuel is injected into the flow of pressurized air, with the resulting mixture being combusted within the combustor 26. The high energy combustion products are directed from the combustor 26 along the hot gas path of the engine 10 to a first (high pressure) turbine 28 for driving the high pressure compressor 24 via a first (high pressure) drive shaft 30, and then to a second (low pressure) turbine 32 for driving the booster compressor 22 and fan section 16 via a second (low pressure) drive shaft 34 that is generally coaxial with first drive shaft 30. After driving each of turbines 28 and 32, the combustion products may be expelled from the core engine 14 via an exhaust nozzle 36 to provide propulsive jet thrust.

It should be appreciated that each turbine 28, 30 may generally include one or more turbine stages, with each stage including a turbine nozzle (not shown in FIG. 1) and a downstream turbine rotor (not shown in FIG. 1). As will be described below, the turbine nozzle may include a plurality of vanes disposed in an annular array about the centerline axis 12 of the engine 10 for turning or otherwise directing the flow of combustion products through the turbine stage towards a corresponding annular array of rotor blades forming part of the turbine rotor. As is generally understood, the rotor blades may be coupled to a rotor disk of the turbine rotor, which is, in turn, rotationally coupled to the turbine's drive shaft (e.g., drive shaft 30 or 34).

Additionally, as shown in FIG. 1, the fan section 16 of the engine 10 may generally include a rotatable, axial-flow fan rotor 38 that configured to be surrounded by an annular fan casing 40. In particular embodiments, the (LP) drive shaft 34 may be connected directly to the fan rotor 38 such as in a direct-drive configuration. In alternative configurations, the (LP) drive shaft 34 may be connected to the fan rotor 38 via a speed reduction device 37 such as a reduction gear gearbox in an indirect-drive or geared-drive configuration. Such speed reduction devices may be included between any suitable shafts/spools within engine 10 as desired or required.

It should be appreciated by those of ordinary skill in the art that the fan casing 40 may be configured to be supported relative to the core engine 14 by a plurality of substantially radially-extending, circumferentially-spaced outlet guide vanes 42. As such, the fan casing 40 may enclose the fan rotor 38 and its corresponding fan rotor blades 44. Moreover, a downstream section 46 of the fan casing 40 may extend over an outer portion of the core engine 14 so as to define a secondary, or by-pass, airflow conduit 48 that provides additional propulsive jet thrust.

During operation of the engine 10, it should be appreciated that an initial air flow (indicated by arrow 50) may enter the engine 10 through an associated inlet 52 of the fan casing 40. The air flow 50 then passes through the fan blades 44 and splits into a first compressed air flow (indicated by arrow 54) that moves through conduit 48 and a second compressed air flow (indicated by arrow 56) which enters the booster compressor 22. The pressure of the second compressed air flow 56 is then increased and enters the high pressure compressor 24 (as indicated by arrow 58). After mixing with fuel and being combusted within the combustor 26, the combustion products 60 exit the combustor 26 and flow through the first turbine 28. Thereafter, the combustion products 60 flow through the second turbine 32 and exit the exhaust nozzle 36 to provide thrust for the engine 10.

Figure 2:
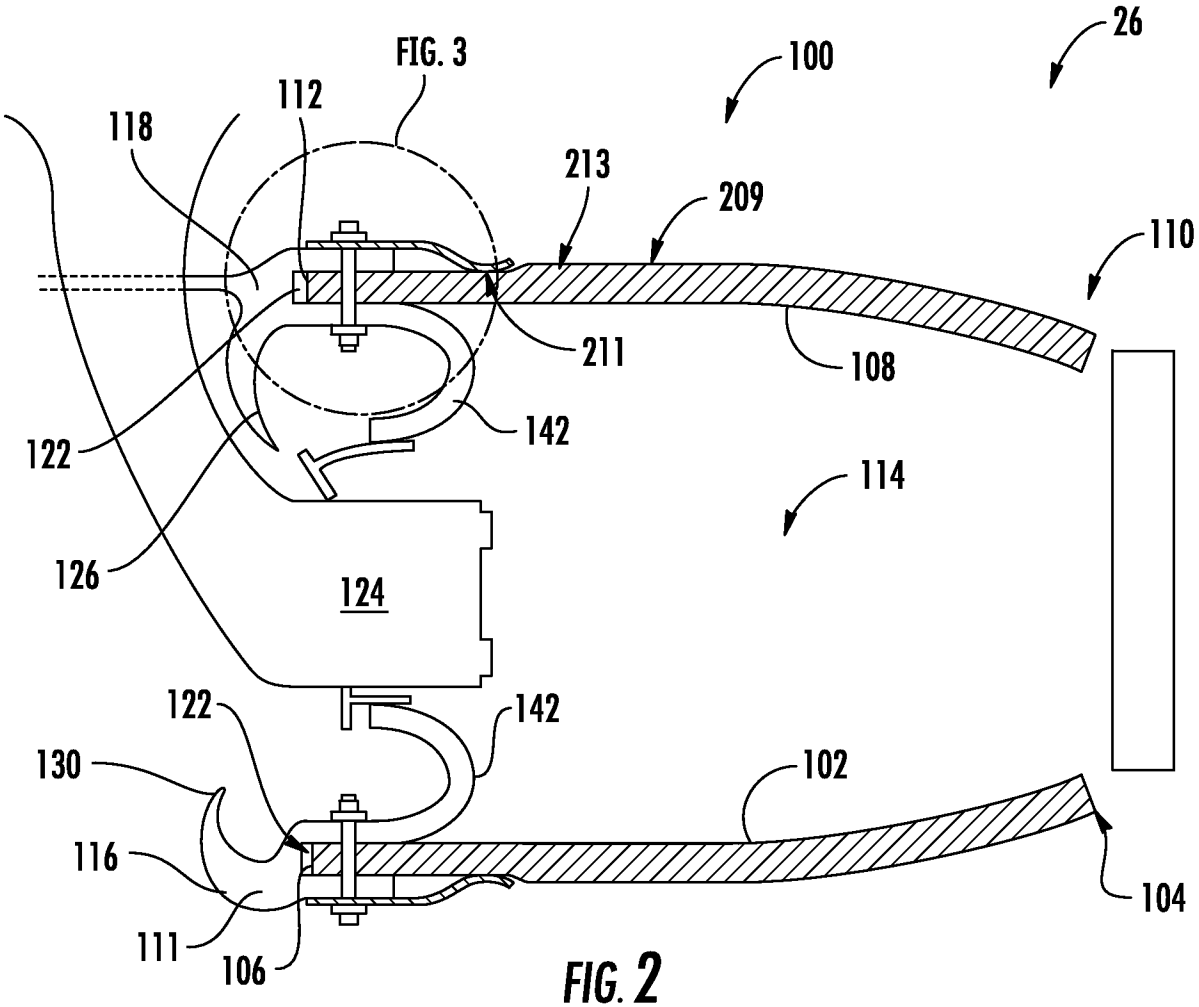
FIG. 2 illustrates a cross-sectional view of one embodiment of a combustor configuration suitable for use within the gas turbine engine shown in FIG. 1.

Referring now to FIG. 2, a cross-sectional view is provided of the combustion section 26 of the exemplary turbofan engine 10 of FIG. 1. More particularly, FIG. 2 provides a perspective, cross-sectional view of a combustor assembly 100, which may be positioned in the combustion section 26 of the exemplary turbofan engine 10 of FIG. 1, in accordance with an exemplary embodiment of the present disclosure. Notably, FIG. 2 provides a perspective, cross-sectional view of the combustor assembly 100 having an outer combustor casing removed for clarity.

Figure 3:
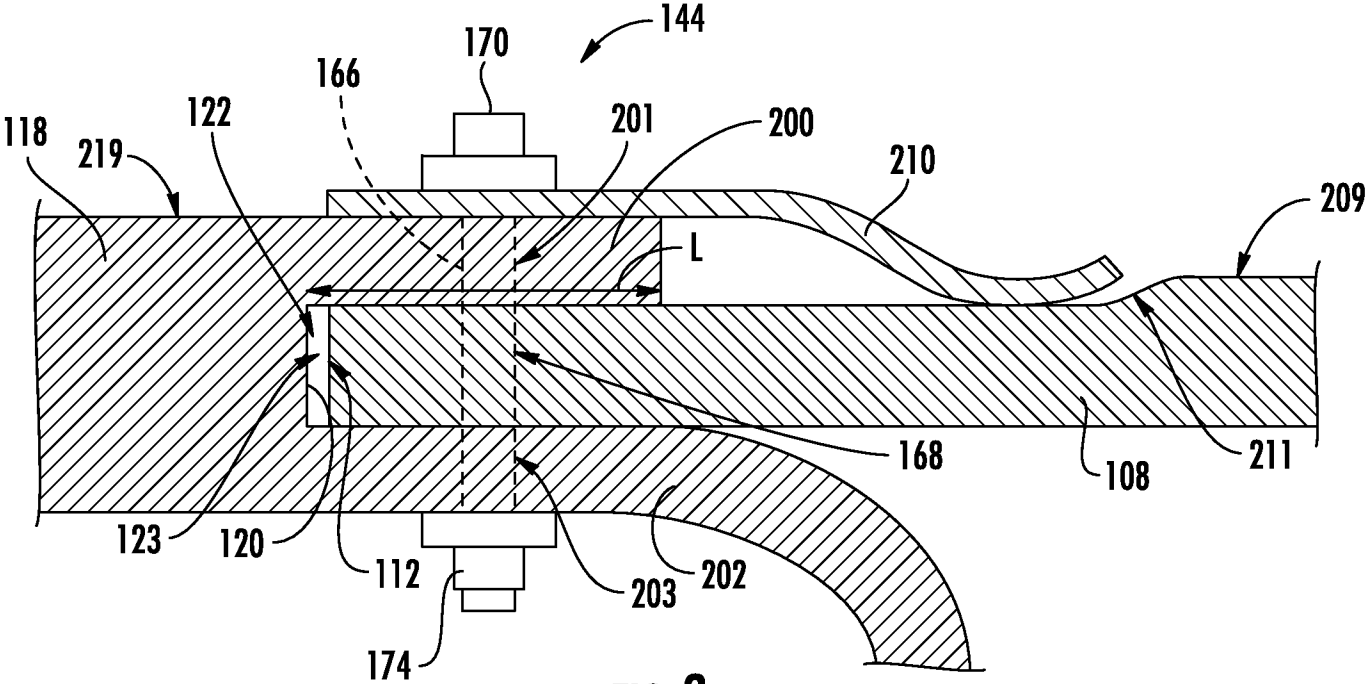
FIG. 3 illustrates a cross-sectional view of one embodiment of the connection between an annular dome and an outer liner in an exemplary combustor, such as shown in FIG. 2.

As shown, the combustor assembly 100 generally includes an inner liner 102 extending between and aft end 104 and a forward end 106 generally along the axial direction, as well as an outer liner 108 also extending between and aft end 110 and a forward end 112 generally along the axial direction. The inner and outer liners 102, 108 together at least partially define a combustion chamber 114 therebetween. The inner and outer liners 102, 108 are each attached to an annular dome 111. More particularly, the combustor assembly 100 includes an inner portion 116 of the annular dome 111 attached to the forward end 106 of the inner liner 102 and an outer portion 118 of the annular dome 111 attached to the forward end 112 of the outer liner 108. As will be discussed in greater detail below, the inner and outer portions 116, 118 of the annular dome 111 each include an enclosed surface 120 defining an annular slot 122 for receipt of the forward ends 106, 112 of the respective inner and outer liners 102, 108. FIG. 3 shows this orientation in greater detail, using the outer liner 108 and outer portion 118 of the annular dome 111 as representative, though the present disclosure is not limited to the outer liner 108 and may be applied similarly to the inner liner 102.

The combustor assembly 100 further includes a plurality of fuel and air mixers 124 spaced along a circumferential direction within the outer portion 118 of the annular dome 111. More particularly, the plurality of fuel air mixers 124 are disposed between the outer portion 118 of the annular dome 111 and the inner portion 116 of the annular dome 111 along the radial direction. Compressed air from the compressor section of the turbofan engine 10 flows into or through the fuel air mixers 124, where the compressed air is mixed with fuel and ignited to create the combustion gases within the combustion chamber 114. The inner and outer domes 116, 118 are configured to assist in providing such a flow of compressed air from the compressor section into or through the fuel air mixers 124. For example, the outer portion 118 of the annular dome 111 includes an outer cowl 126 at a forward end 128 and the inner portion 116 of the annular dome 111 similarly includes an inner cowl 130 at a forward end 132. The outer cowl 126 and inner cowl 130 may assist in directing the flow of compressed air from the compressor section 26 into or through one or more of the fuel air mixers 124.

Moreover, the inner and outer domes 116, 118 can each include attachment portions configured to assist in mounting the combustor assembly 100 within the turbofan engine 10. For example, the outer portion 118 of the annular dome 111 can include an attachment extension configured to be mounted to an outer combustor casing and the inner portion 116 of the annular dome 111 can include a similar attachment extension configured to attach to an annular support member within the turbofan engine 10. In certain exemplary embodiments, the inner portion 116 of the annular dome 111 may be formed integrally as a single annular component, and similarly, the outer portion 118 of the annular dome 111 may also be formed integrally as a single annular component. It should be appreciated, however, that in other exemplary embodiments, the inner portion 116 of the annular dome 111 and/or the outer portion 118 of the annular dome 111 may be formed by one or more components joined in any suitable manner. For example, with reference to the outer portion 118 of the annular dome 111, in certain exemplary embodiments, the outer cowl 126 may be formed separately from the outer portion 118 of the annular dome 111 and attached to outer portion 118 of the annular dome 111 using, e.g., a welding process. Similarly, any attachment extension may also be formed separately from the outer dam 118 and attached to the outer portion 118 of the annular dome 111 using, e.g., a welding process. Additionally, or alternatively, the inner portion 116 of the annular dome 111 may have a similar configuration.

Referring still to FIG. 2, the exemplary combustor assembly 100 further includes a heat shield 142 positioned around each fuel air mixer 124, arrange circumferentially. The heat shields 142, for the embodiment depicted, are attached to and extend between the outer portion 118 of the annular dome 111 and the inner portion 116 of the annular dome 111. The heat shields 142 are configured to protect certain components of the turbofan engine 10 from the relatively extreme temperatures of the combustion chamber 114.

For the embodiment depicted, the inner liner 102 and outer liner 108 are each comprised of a ceramic matrix composite (CMC) material, which is a non-metallic material having high temperature capability. Exemplary CMC materials utilized for such liners 102, 108 may include silicon carbide, silicon, silica or alumina matrix materials and combinations thereof. Ceramic fibers may be embedded within the matrix, such as oxidation stable reinforcing fibers including monofilaments like sapphire and silicon carbide (e.g., Textron's SCS-6), as well as rovings and yarn including silicon carbide (e.g., Nippon Carbon's NICALON®, Ube Industries' TYRANNO®, and Dow Corning's SYLRAMIC®), alumina silicates (e.g., Nextel's 440 and 480), and chopped whiskers and fibers (e.g., Nextel's 440 and SAFFIL®), and optionally ceramic particles (e.g., oxides of Si, Al, Zr, Y and combinations thereof) and inorganic fillers (e.g., pyrophyllite, wollastonite, mica, talc, kyanite and montmorillonite). CMC materials may have coefficients of thermal expansion in the range of about $1.3\times10^{-6}$ in/in/° F. to about $3.5\times10^{6}$ in/in/° F. in a temperature of approximately 1000-1200° F.

By contrast, the inner portion 116 of the annular dome 111 and outer portion 118 of the annular dome 111, including the inner cowl 130 and outer cowl 126, respectively, may be formed of a metal, such as a nickel-based superalloy (having a coefficient of thermal expansion of about $8.3\text{-}8.5\times10^{-6}$ in/in/° F. in a temperature of approximately 1000-1200° F.) or cobalt-based superalloy (having a coefficient of thermal expansion of about $7.8\text{-}8.1\times10^{-6}$ in/in/° F. in a temperature of approximately 1000-1200° F.). Thus, the inner and outer liners 102, 108 may be better able to handle the extreme temperature environment presented in the combustion chamber 114. However, attaching the inner and outer liners 102, 108 to the respective inner and outer domes 116, 118 presents a problem due to the differing mechanical characteristics of the components. Accordingly, as will be discussed below, a specially designed mounting assembly 144 is utilized to attach the forward end 106 of the inner liner 102 to the inner portion 116 of the annular dome 111, as well as to attach the forward end 112 of the outer liner 108 to the outer portion 118 of the annular dome 111. The mounting assemblies 144 are configured to accommodate the relative thermal expansion between the inner and outer domes 116, 118 and the inner and outer liners 102, 108, respectively, along the radial direction.

Referring now particularly to FIG. 3, a close up, cross-sectional view of an attachment point where the forward end 112 of the outer liner 108 is attached to the outer annular dome 118 is depicted. As stated, to allow for a relative thermal expansion of the outer liner 108 and outer portion 118 of the annular dome 111, the mounting assemblies 144 are provided extending through the annular slots 122 defined by the inner surface 120 between an outer arm 200 and an inner arm 202. More particularly, referring specifically to the outer portion 118 of the annular dome 111 and forward end 112 of the outer liner 108 depicted in FIG. 3, the outer portion 118 of the annular dome 111 includes an outer arm 200 and an inner arm 202 that extend substantially parallel to one another, which for the embodiment depicted is a direction substantially parallel to the axial direction of the turbofan engine 10.

For the embodiment depicted, the mounting assembly 144 includes a pin member 166 and an optional bushing 168 that extend through apertures 201, 203 defined in the outer arm 200 and the inner arm 202, respectively. The pin member 166 includes a head 170 and a nut 174 is attached to a distal end of the pin member 166. In certain exemplary embodiments, the pin member 166 may be configured as a bolt and the nut 174 may be rotatably engaged with the pin member 166 for tightening the mounting assembly 144. Alternatively, however, in other exemplary embodiments, the pen member 166 and nut 174 may have any other suitable configuration. For example, in other exemplary embodiments, the pin 166 may include a body 172 defining a substantially smooth cylindrical shape in the nut 174 may be configured as a clip. Additionally, the bushing 168 is generally cylindrical in shape and positioned around the pin member 166.

Figure 4:
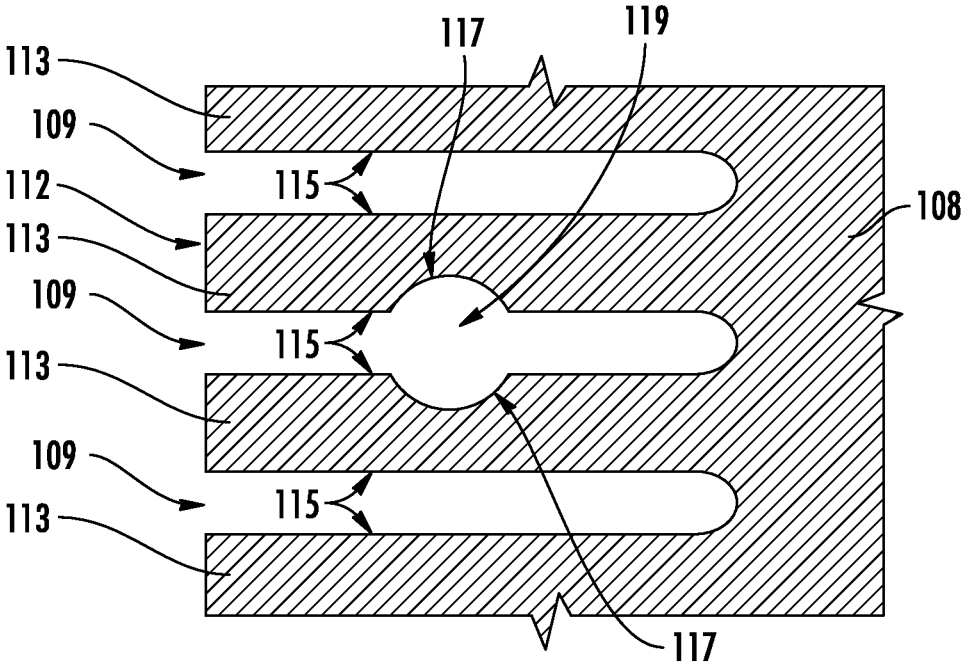
FIG. 4 shows a top view of an exemplary forward end of an outer liner according to one embodiment.
Figure 5:
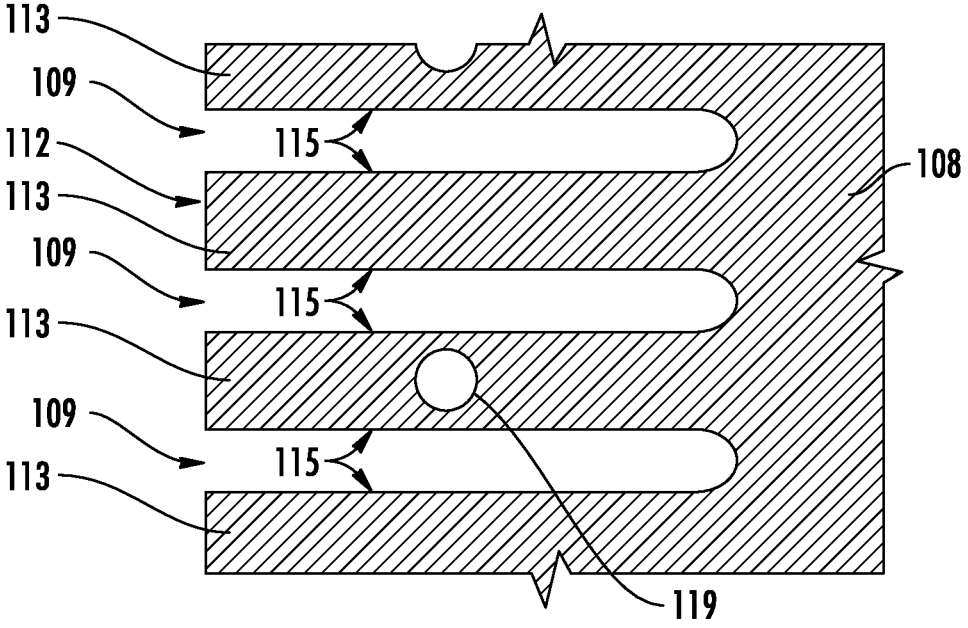
FIG. 5 shows a top view of an exemplary forward end of an outer liner according to another embodiment.

Referring to FIG. 4, the forward end 112 of the outer liner 108 includes a plurality of fingers 113. The fingers 113 are spaced apart from each other to define a slot 109 between adjacent fingers 113. Thus, a plurality of slots 109 are defined annularly on the outer liner 108. As show, each finger 113 defines a pair of longitudinal edges 115. In the array of fingers 113, at least a portion of oppositely facing longitudinal edges of adjacent fingers 113 have an indentation 117 therein to as to define an opening 119 for receipt of a pin member or bushing therethrough. That is, the indentations 117 on adjacent fingers 113 substantially align to receive the pin member 168 therethrough. The indentation 117 and the pin member 166 (or bushing 166) can be sized so as to fit together such that the outer liner 108 is secured in place while allowing for some movement in the axial direction to account for differences in the thermal expansion discussed above. FIG. 5 shows a similar embodiment where at least one finger 113 defines an opening 119 between the pair of longitudinal edges 115 (i.e., within the body of the finger 113) for receipt of a pin member or bushing therethrough. Of course, features from both FIGS. 4 and 5 may be combined, if desired.

Referring again to FIG. 3, a terminal end 112 of each finger 113 extends into the annular slot 122 and can form a gap 123 between an inner surface 120 of the annular slot 122 of the annular dome 118 and the terminal end 112 of each finger 113. In particular embodiments, the outer arm 200 of the annular slot 122 of the annular dome 118 defines a slot length (L), and wherein the gap 123 defined from the inner surface 120 of the annular slot 122 of the annular dome 118 to the terminal end 112 of each finger 112 has a length of about 1% to about 25% of the slot length (L) at room temperature (i.e., about 25° C.), such as about 1% to about 10%. In other embodiments, the terminal end 112 of each finger 113 can contact the inner surface 120 of the annular slot 122 of the annular dome 118.

FIG. 3 also shows a feather seal 210 extending from an annularly exterior surface 209 of the annular dome 118 to an annularly exterior surface 219 of the outer liner 108. The feather seal 210 is, in the embodiment shown, in a spring loaded contact with the annularly exterior surface 209 of the outer liner 108. In one embodiment, the feather seal 210 comprises a metal with a wear coating thereon such that the wear coating contacts the annularly exterior surface 209 of the outer liner 108. The feather seal 210 generally forms a fluid-tight barrier between the internal combustion chamber 114 and the space external of the inner liner 102 and outer liner 108, and inhibits the flow of gas therethrough.

In particular embodiments, the outer liner 108 defines a tapered portion 211. That is, the outer liner 108 has a thickness in its body portion 213 that is greater than the thickness of the fingers 113 and/or at its forward end 112. In the embodiment shown in FIG. 3, the annularly exterior surface 209 defines a taper 211. However, in other embodiments, the tapered surface can be on the annularly inner surface opposite of the annularly exterior surface 209.

Each pin member 166 extends through an aperture in the feather seal 211, through an aperture in the outer arm 200 of the annular dome 118, through an axial slot 109 in the outer liner 108, and through an aperture in the inner arm 202 of the annular dome 118 to secure the components together. The number of pin members 166 annularly securing the outer annular dome 118 may be the same as the number of slots 109 (i.e., one pin member 166 extending through each slot 109); may be less than the number of slots 109; or more than the number of slots 109. That is, the plurality of axial slots 109 can be greater in number than the plurality of pin members 116, to allow for radial expansion and contraction of the outer liner 108 in certain embodiments. However, in other embodiments, the plurality of axial slots 109 can be lesser in number than the plurality of pin members 116 (e.g., when using wider and/or longer fingers, more than 1 pin member 166 may be utilized per finger).

A combustor in accordance with an exemplary embodiment of the present disclosure assembly having a cap positioned over an inner liner or an outer liner may be capable of controlling an airflow from a relatively high pressure plenum or a relatively high pressure inner passage into a combustion chamber through an attachment point between the inner or outer liners and an inner or outer dome. Moreover, such a combustor assembly may be capable of controlling an airflow from a relatively high pressure plenum or a relatively high pressure inner passage into a combustion chamber through an attachment point between the inner or outer liners and an inner or outer dome while still accommodating a relative thermal expansion between the inner or outer liners and inner or outer domes.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A combustor for a gas turbine engine having a longitudinal centerline axis extending therethrough, the combustor comprising:

a liner comprising a ceramic matrix composite material and having a forward end and an aft end, wherein the forward end defines a plurality of fingers and a plurality of axial slots;

an annular dome comprising a metal and defining an annular slot between an outer arm and an inner arm, wherein the forward end of the liner is fitted between the outer arm and the inner arm within the annular slot;

a feather seal extending from an annularly exterior surface of the annular dome to an annularly exterior surface of the liner; and a plurality of pin members, wherein each pin member of the plurality of pin members extends through an aperture in the feather seal, through an aperture in the outer arm of the annular dome, through an opening defined by the liner, and through an aperture in the inner arm of the annular dome.

2. The combustor as in claim 1, wherein each finger of the plurality of fingers defines a pair of longitudinal edges, and wherein at least a portion of oppositely facing longitudinal edges of adjacent fingers of the plurality of fingers have an indentation therein to define the opening through the liner.

3. The combustor as in claim 2, wherein the indentation on the adjacent fingers of the plurality of fingers substantially align to receive the respective pin member of the plurality of pin members therethrough.

4. The combustor as in claim 1, wherein each finger of the plurality of fingers defines a pair of longitudinal edges, and wherein at least one of the plurality of fingers define the opening between the pair of longitudinal edges.

5. The combustor as in claim 1, wherein a terminal end of each finger of the plurality of fingers extends into the annular slot to form a gap between an inner surface of the annular slot of the annular dome and the terminal end of each finger of the plurality of fingers.

6. The combustor as in claim 5, wherein the outer arm of the annular slot of the annular dome defines a slot length, and wherein the gap defined from the inner surface of the annular slot of the annular dome to the terminal end of each finger of the plurality of fingers has a length of about 1% to about 25% of the slot length at about 25° C.

7. The combustor as in claim 5, wherein the outer arm of the annular slot of the annular dome defines a slot length, and wherein the gap defined from the inner surface of the annular slot of the annular dome to the terminal end of each finger of the plurality of fingers has a length of about 1% to about 10% of the slot length at about 25° C.

8. The combustor as in claim 1, wherein each pin member of the plurality of pin members is a bolt.

9. The combustor as in claim 1, wherein the annularly exterior surface of the liner defines a taper.

10. The combustor as in claim 9, wherein the liner has a thickness at a body portion that is greater than a thickness at the forward end of the liner.

11. The combustor as in claim 9, wherein the taper defined by the annularly exterior surface of the liner couples to the feather seal.

12. The combustor as in claim 1, wherein the feather seal is in a spring loaded contact with the annularly exterior surface of the liner.

13. The combustor as in claim 1, wherein the feather seal comprises a metal with a wear coating thereon, and wherein the wear coating contacts the annularly exterior surface of the liner.

14. The combustor as in claim 1, wherein the aft end of the liner is free-floating.

15. The combustor as in claim 1, wherein the plurality of axial slots is greater in number than the plurality of pin members.

16. The combustor as in claim 1, wherein the annular slot of the annular dome has a slot distance from an outer surface of the outer arm to an inner surface of the inner arm, and wherein the forward end of the liner has a thickness that is about 90% to 100% of the slot distance.

17. A gas turbine engine, comprising:

a compressor;

a combustor;

a turbine, wherein the combustor comprises:

a liner comprising a ceramic matrix composite material and having a forward end and an aft end, wherein the forward end defines a plurality of fingers and a plurality of axial slots;

an annular dome comprising a metal and defining an annular slot between an outer arm and an inner arm, wherein the forward end of the liner is fitted between the outer arm and the inner arm within the annular slot;

a feather seal extending from an annularly exterior surface of the annular dome to an annularly exterior surface of the liner; and a plurality of pin members, wherein each pin member of the plurality of pin members extends through an aperture in the feather seal, through an aperture in the outer arm of the annular dome, through an opening in the liner, and through an aperture in the inner arm of the annular dome.

18. The gas turbine engine as in claim 17, wherein a terminal end of each finger of the plurality of fingers extends into the annular slot to form a gap between an inner surface of the annular slot of the annular dome and the terminal end of each finger, and wherein the outer arm of the annular slot of the annular dome defines a slot length, and further wherein the gap defined from the inner surface of the annular slot of the annular dome to the terminal end of each finger has a length of about 1% to about 25% of the slot length.

* * * * *